United States Patent [19]

Rodon

[11] 4,343,453

[45] Aug. 10, 1982

[54] MOULD FOR PRODUCING CONCRETE MOULDINGS

[75] Inventor: Guenter Rodon, Erbach, Fed. Rep. of Germany

[73] Assignee: Rampf KG Formen GmbH & Co., Allmendingen, Fed. Rep. of Germany

[21] Appl. No.: 166,340

[22] Filed: Jul. 7, 1980

[30] Foreign Application Priority Data

Apr. 2, 1980 [DE] Fed. Rep. of Germany ..... 3012817

[51] Int. Cl.[3] ..... B28B 1/14; B28B 7/16

[52] U.S. Cl. ..... 249/120; 249/124; 249/135; 249/142; 425/253; 425/434; 425/DIG. 111

[58] Field of Search ..... 249/119, 120, 122, 124, 249/117, 135, 142, 121, 118; 425/DIG. 111, 434, 432, 456; 52/581, 574, 599; 403/231, 406, 408, 364; 361/393, 394; 211/133, 126; 248/DIG. 6; 264/297

[56] References Cited

U.S. PATENT DOCUMENTS

| | | | |
|---|---|---|---|
| 573,455 | 12/1896 | Ervin | 249/119 |
| 691,874 | 1/1902 | Robinson | 220/3.9 |
| 1,335,554 | 3/1920 | Callahan | 403/231 |
| 1,409,591 | 3/1922 | Schavoir | 249/119 |
| 1,509,079 | 9/1924 | Martin | 249/119 |
| 1,528,890 | 3/1925 | Petersen | 249/120 |
| 1,748,101 | 2/1930 | Bentley | 249/120 |
| 1,790,031 | 1/1931 | Vaughn | 220/3.9 |
| 1,854,079 | 4/1932 | Strickland | 249/119 |
| 1,981,203 | 11/1934 | Siems | 249/122 |
| 2,448,827 | 9/1948 | Reder | 249/120 |
| 2,567,549 | 9/1951 | Christensen | 249/122 |
| 2,932,369 | 4/1960 | Huguenin | 403/22 |
| 3,835,610 | 9/1974 | Harper et al. | 403/409 |

FOREIGN PATENT DOCUMENTS

| | | | |
|---|---|---|---|
| 2536926 | 2/1977 | Fed. Rep. of Germany . | |
| 1455295 | 11/1976 | United Kingdom | 403/22 |

*Primary Examiner*—Willard E. Hoag
*Attorney, Agent, or Firm*—Amster, Rothstein & Engelberg

[57] ABSTRACT

A mould for producing concrete mouldings having a frame and a plurality of moulding boxes therein with the moulding boxes removably fastened directly to the bottom end faces of the frame.

6 Claims, 5 Drawing Figures

Figure 1:
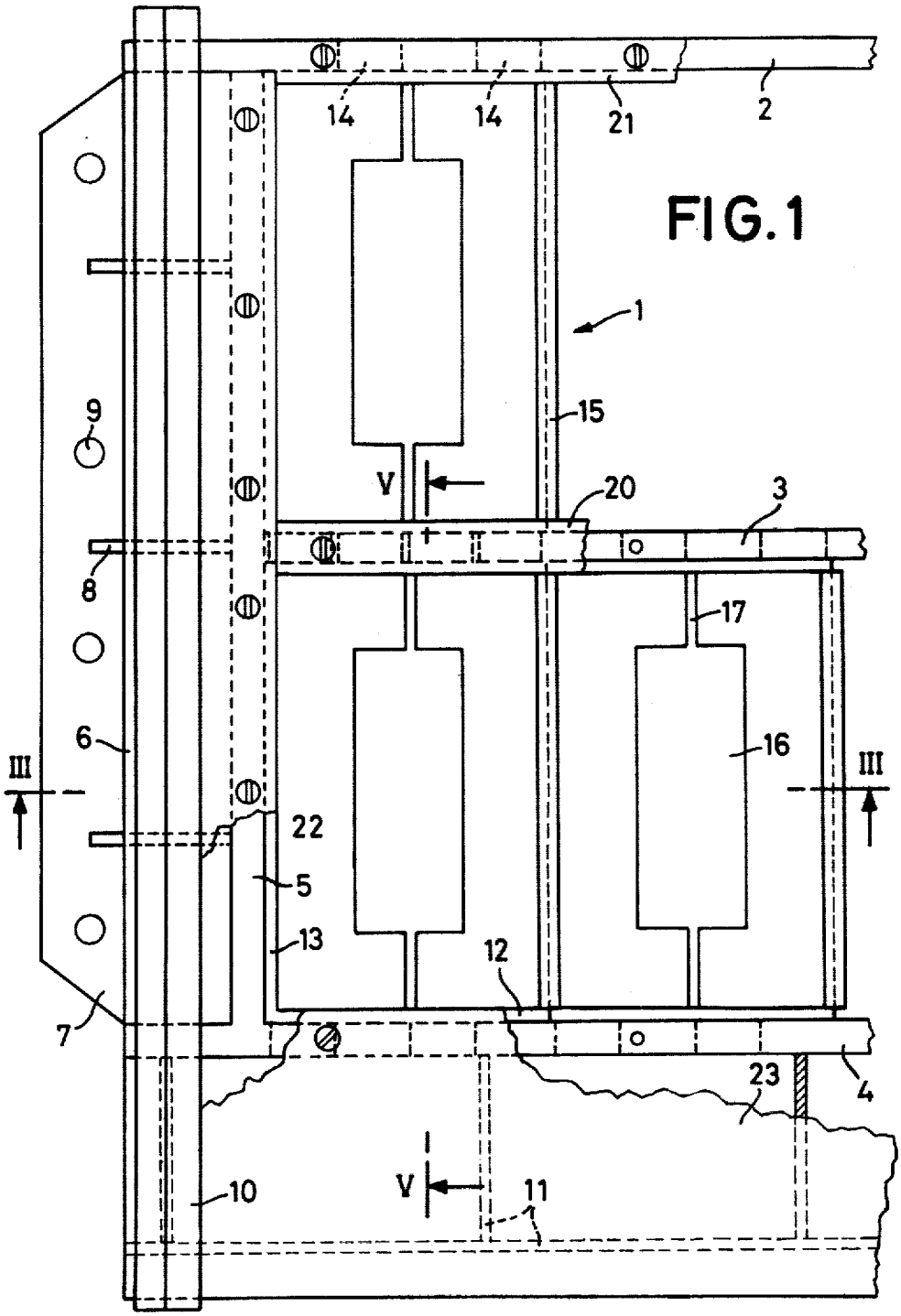

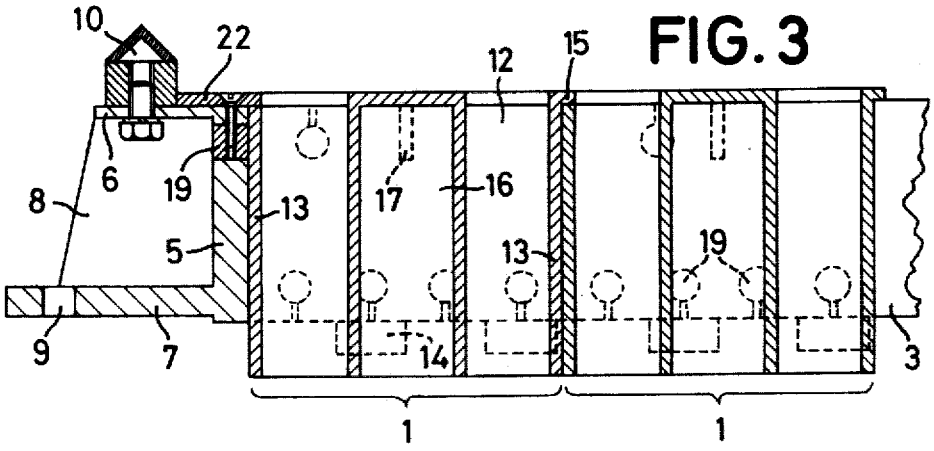
FIG. 3
FIG. 4
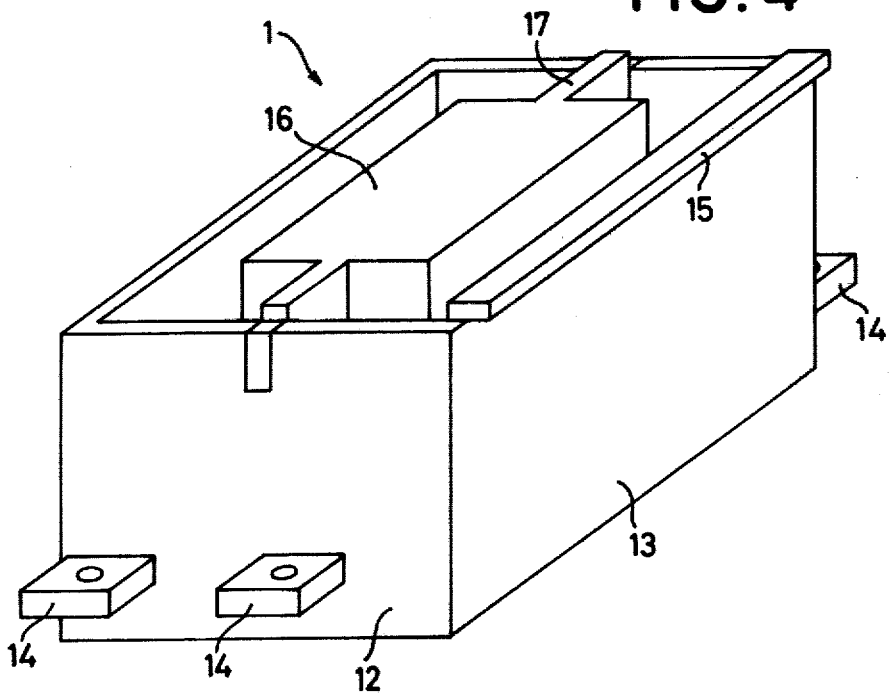

MOULD FOR PRODUCING CONCRETE MOULDINGS

The invention relates to a mould for producing concrete mouldings with a frame insertible into a moulding machine and with a plurality of individual moulding boxes contained in said frame, the interiors of which correspond to the mouldings to be formed.

A mould of this type is known e.g., from German Auslegeschrift No. 25 36 926. The individual moulding boxes have top and bottom peripheral flanges provided with abutting surfaces, and a peripheral groove, and are wedged into an outer frame by means of longitudinal and transverse wedges and optionally by means of keys. This subdivision into exchangeable individual moulds is intended to economise costs compared to integral welded moulds, because in the case of local damage only the relevant individual moulding box has to be replaced.

However, this known mode of wedge connection of the individual moulding boxes among themselves and of the individual moulding boxes with the mould frame is far from adequate to withstand the extraordinarily high agitating loads in high-speed moulding machines. This is true to a greater extent as the overall mould is larger. Particularly in the case of two-row or multiple row arrangement of the individual moulds, the wedges cannot absorb the vertical flexural loads, so that the moulding boxes rub against each other and are subjected to wear, including at the fitting surfaces. The production of the known individual moulds is comparatively onerous because of the precision of fit required in the peripheral grooves. The known mould is complicated to handle, because it is necessary to disassemble the entire mould in order to exchange a single moulding box.

The invention has the aim to produce a mould which is simpler in construction and yet more rigid, and the individual moulding boxes of which can be exchanged easily and rapidly.

This is achieved according to the invention, starting from a mould of the type initially defined, in that the moulding boxes are screwed to the bottom end faces of the frame by means of support flanges mounted laterally on the moulding box walls.

This has the advantage that the frame and the moulding boxes are in direct mutual abutment including in the vertical direction, and the compressive forces of the frame are therefore absorbed by the support flanges, whilst the screw connections are not subjected to any load. Above all, this construction permits the removal of an individual moulding box, for which purpose it is only necessary to release the screw fittings, but the cohesion of the remaining moulding boxes in the frame is preserved.

In the case of a multiple-row arrangement of the individual moulding boxes, a partition wall connected to the outer members of the frame extends between each two rows of moulding boxes. Said partition wall can easily be dimensioned for a sufficiently high load capacity including in the vertical direction. So that the support flanges of the moulding boxes arranged on both sides of a partition wall do not interfere with each other, it is proposed that only short support flanges are used and that the support flanges on both sides of a moulding box are staggered mutually in the longitudinal direction of the rows and have sufficiently large mutual intervals. Thus the support flanges of the moulding boxes of the one side engage the partition wall between the support flanges of the moulding boxes of the other side. The individual moulding boxes are thus identical among themselves and can be produced in series.

In order to restrict the wear to the top moulding box edges and to prevent the penetration of particles of the concrete filling mixture between the walls of the individual moulding boxes, it is proposed that the moulding boxes exhibit an outwardly overhanging masking rim at one of their top edges. This masks the top end face of the moulding box wall adjacent in the direction of the row. For the same purpose, laterally overhanging masking strips which mask the top end faces of the remaining moulding box walls, particularly of the walls oriented in the longitudinal direction of the rows, may be screwed to the top end faces of the frame.

In such heavy-duty apparatuses exposed to corrosive influences, the screwthreads of the fixing screws are greatly threatened. According to experience, screws frequently have to be drilled out because the screw heads have been completely ground away by the moulding mixture. It is therefore proposed, in order to ensure a long period of use for the frame, that insert nuts with transversely oriented screwthreaded bores are introduced into the frame walls from the side and that the screws for fixing the moulding boxes, and also those for the masking strips, engage through vertical passage bores—i.e., oriented parallel to the frame wall surface—and are screwed to the insert nuts. Now if it is necessary for a screw to be drilled out, the insert nut is simply replaced by a new one.

Figure 2:
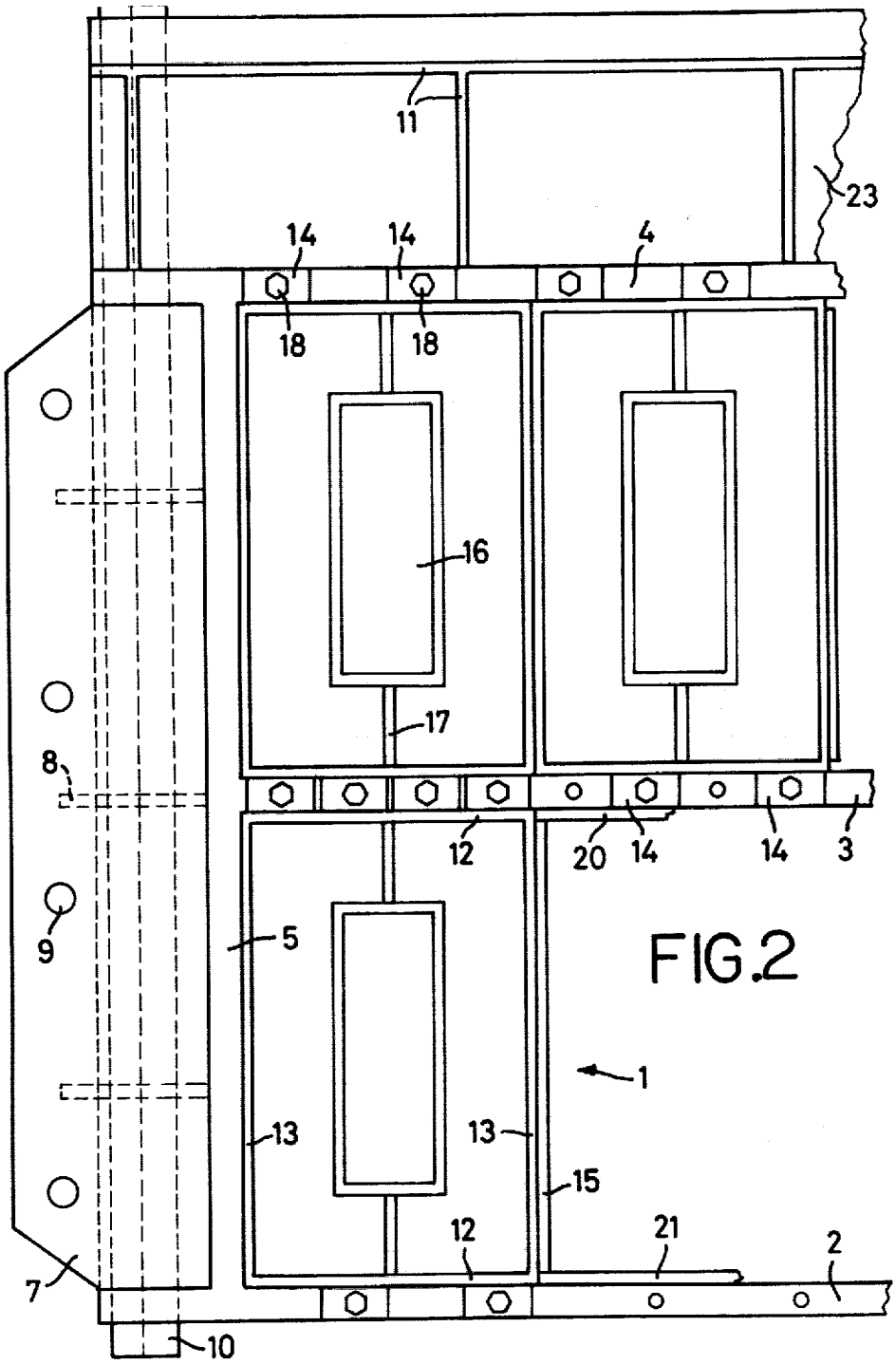
Figure 5:
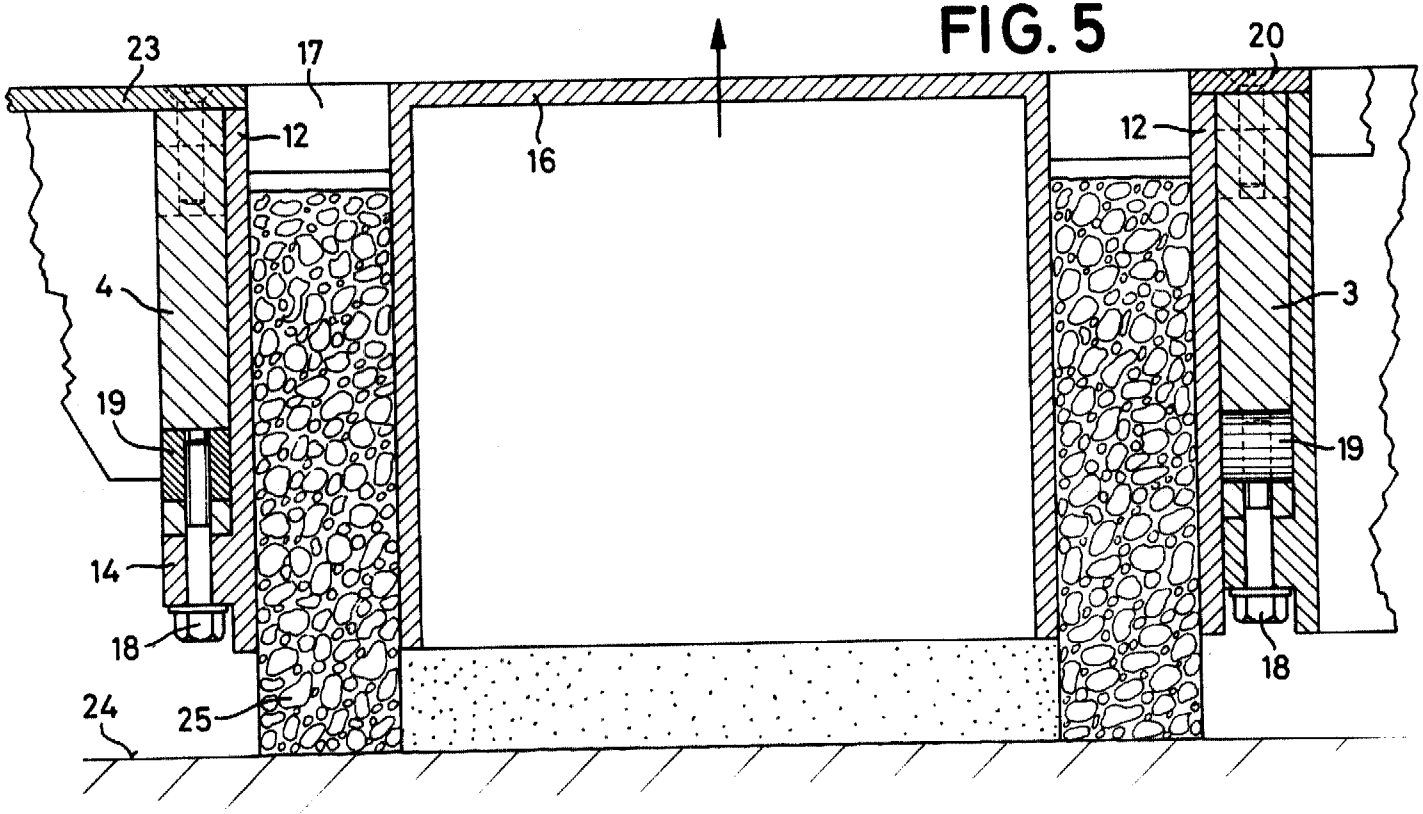

An exemplary embodiment of the invention is explained hereinbelow with reference to the accompanying drawings, wherein:

FIG. 1 shows in plan a fragment of a mould, in which only three moulding boxes are inserted, FIG. 2 shows the bottom plan of the mould according to FIG. 1, FIG. 3 shows a cross-section III—III of the mould according to FIG. 1, FIG. 4 shows a schematic perspective view of an individual moulding box and FIG. 5 shows a partial section V—V of the mould according to FIG. 1 on a larger scale.

The mould according to the drawing comprises a frame and individual moulding boxes 1. The frame exhibits three longitudinal walls 2 to 4 and two transverse walls 5. The entire mould is longer in the direction of the longitudinal walls than transversely thereto. It comprises a total of ten moulding boxes in two rows of five each and terminates with a transverse wall part corresponding in mirror image to the fragment illustrated.

Two stiffening rails 6 and 7 (FIG. 3) and ribs 8 are attached externally to the transverse walls 5. The lower, somewhat wider stiffening rails 7 exhibit bores 9 for attaching the mould to the moulding machine. A prism 10 is screwed onto each of the upper stiffening rails 6. The filling trucks of the moulding machine run on said prisms, which project beyond the longitudinal wall 4 to one side. A stiffening rib system 11 is further fitted to the outside of the longitudinal wall 4.

The individual moulding boxes 1 (FIG. 4) are each constituted by two short longitudinal walls 12 and two longer transverse walls 13. Two support flanges 14 are welded to each of the longitudinal walls 12 with a mutual interval which is greater than the length of the support flanges measured in that direction. The support flanges 14 on the two sides of the moulding box 1 are also staggered mutually in the longitudinal direction by half a flange interval. An overhanging masking rim 15 is welded to one of the two transverse walls 13. During the mutual alignment of the individual moulding boxes in the frame, said masking rims 15 engage over the adjoining transverse wall of the adjacent moulding box.

In the example the moulding boxes 1 each exhibit a simple parallelepipedic core 16 which is maintained by struts 17 on the longitudinal walls 12. Obviously, the moulding boxes may also have all possible other interior shapes, such as are customary e.g., for pumice concrete or other hollow stone blocks.

The moulding boxes 1 are fitted into the frame from beneath, whilst the support flanges 14 rest upon the bottom end faces of the longitudinal walls 2 to 4. Fastening is effected, as shown most clearly in FIG. 5, by means of screws 18 and cylindrical insert nuts 19. The latter are inserted into corresponding bores of the longitudinal walls 2, 3 and 4. On the right-hand side in FIG. 5, the insert nut 19 is not cut. In the same way hardened masking elements are screwed by means of countersunk screws onto the top end faces of the longitudinal and transverse walls of the frame, namely a masking strip 20 overhanging to both sides onto the central longitudinal wall 3, inwardly overhanging masking strips 21 and 22 onto the outer longitudinal wall 2 and the transverse walls 5, and a likewise inwardly overhanging masking plate 23, which is also secured in suitable manner to the rib system 11, onto the longitudinal wall 4.

The moulding boxes are hardened after production and external machining. Obviously they may also have other external dimensions, particularly be twice as long as shown, provided only that the interval pattern of the bores of the support flanges 14 and of the insert nuts 19 on the underside of the longitudinal walls of the frame is adapted to the fixing of said moulding boxes.

In the moulding machine, the mould described rests by the bottom end faces of the moulding boxes 1 upon a plane work surface 24 (FIG. 5). The weight of the frame thus rests upon the support flanges 14. The mould is filled from above, the agitating movement is introduced through the stiffening and fixing rails 7. FIG. 5 shows the lifting off of the mould after the agitation. The moulding 25, a hollow concrete block, remains behind on the work surface 24.

It is of great practical significance that such a mould can be calculated very simply, because the frame alone absorbs the flexural forces and no additional stresses result from the connection of the moulding boxes to the frame. A further advantage lies in the fact that the moulding boxes can be produced with comparatively wide dimensional tolerances. Thus, for example, air gaps between the individual moulding boxes or between the masking elements and the top end faces of the moulding boxes are harmless provided that they do not exceed 1 millimeter.

I claim:

1. A mold for producing concrete moldings comprising a frame insertable into a molding machine and a plurality of individual molding boxes mounted in said frame, said frame having a longitudinally extending central wall and said molding boxes being arranged in said frame in two parallel rows on opposite sides of said central wall, the interiors of said molding boxes containing a molding core corresponding to the moldings to be formed, each of said molding boxes having a pair of opposed longitudinal walls and a pair of opposed transverse walls joined together to form the outer walls of said molding box surrounding the mold core, said molding boxes each having at least two support flanges joined to and extending outwardly from each of the opposed longitudinal walls, the support flanges on one longitudinal wall being positioned with respect to the support flanges on the opposite longitudinal wall to provide sufficient space between the support flanges of the molding boxes to permit flanges of the molding boxes to be secured to the central wall with the flanges of the molding boxes in one row secured to the central wall between the flanges of the molding boxes of the opposed row of molding boxes.

2. Mould according to claim 1, characterised in that the moulding boxes exhibit at one of their top edges an outwardly overlapping masking rim (15) which masks the top end face of the adjacent moulding box wall.

3. Mould according to claim 1, characterised in that laterally overhanging masking strips (20 to 23) which mask the top end faces of the adjacent moulding box walls are screwed onto the top end faces of the frame.

4. The mold of claim 1, wherein said frame includes frame walls having insert nuts mounted therein, said insert nuts being threaded with the threads oriented transversely to the frame so that attachments between said frame and said molding boxes can be made by vertically orienting holding members which extend into interlocking engagement with the threaded bores of said insert nuts.

5. A mold for producing concrete moldings comprising a frame insertable into a molding machine have a pair of trasverse and longitudinal outer walls and a longitudinal central wall, molding cores corresponding to the moldings to be formed, a plurality of molding boxes each having a pair of opposed transverse and longitudinal walls joined together to form the outer wall of said molding box containing molding cores, each of said molding boxes having at least one support flange joined with and extending outward from each longitudinal wall, said molding boxes adapted to be arranged in two parallel rows in the frame on opposite sides of said central wall with the support flanges engaging the longitudinal and central walls of said frame, and means for engaging the walls of said frame and the flanges of said mold boxes for securing said molding boxes to said frame said support flanges of boxes on one side of said central wall engaging said wall between support flanges of boxes on the opposite side of said central wall.

6. The mold of claim 5 wherein said frame includes a frame wall having insert nuts mounted therein; said insert nuts being threaded with the threads oriented transversely to the frame so that attachments between said frame and said molding boxes can be made by vertically orienting holding members which extend into interlocking engagement with the threaded bores of said insert nuts.

* * * * *